US006043832A

United States Patent [19]

Harada et al.

[11] Patent Number: 6,043,832

[45] Date of Patent: Mar. 28, 2000

[54] METHOD OF AND SYSTEM FOR DRIVING THERMAL HEAD INCLUDING A PLURALITY OF HEATING ELEMENTS

[75] Inventors: Hironori Harada, Chiryu; Kazumi Kanda, Nishikasugai-gun, both of Japan

[73] Assignee: Brother Kogyo Kabushiki Kaisha, Nagoya, Japan

[21] Appl. No.: 09/096,337

[22] Filed: Jun. 12, 1998

[30] Foreign Application Priority Data

Jun. 13, 1997 [JP] Japan ..... H9-156968

[51] Int. Cl.[7] ..... B41J 2/36; B41J 2/37

[52] U.S. Cl. ..... 347/190; 347/186; 347/180; 347/192

[58] Field of Search ..... 347/188, 180, 347/186, 190, 192; 400/120.1, 120.09

[56] References Cited

U.S. PATENT DOCUMENTS 5,160,941 11/1992 Fujiwara et al. .
5,248,995 9/1993 Izumi .

FOREIGN PATENT DOCUMENTS 0 274 905 A2 7/1988 European Pat. Off. .
0 673 774 A2 9/1995 European Pat. Off. .
60-59858 4/1985 Japan .
62-297179 12/1987 Japan .
2-196668 8/1990 Japan .
7-68825 3/1995 Japan .

*Primary Examiner*—Huan Tran
*Attorney, Agent, or Firm*—Oliff & Berridge, PLC

[57] ABSTRACT

In an inventive method of driving a thermal head including heating resistors corresponding to a line of dots, the heating resistors are grouped into blocks consisting of the same number of heating resistors. After producing main printing data for one line of printing, such blocks where the ratio of the number of heating resistors in which the printing data is inputted to the number of all the heating resistors in each block is smaller than a preset ratio, are detected as target blocks. Then, auxiliary printing data for preheating such heating resistors in each target block to which the main printing data is inputted, is produced. When the total number of the heating resistors in all the blocks to which the main printing data is inputted is larger than a preset number, the auxiliary strobe signal is inputted to the heating resistors to preheat the heating resistors in the target blocks. By this preheating, the shortage of energy due to voltage drop of a power source will be compensated.

16 Claims, 6 Drawing Sheets

T
AUX. STROBE INTERRUPTION
250 μsec
250 μsec
250 μsec

MAIN STROBE INTERRUPTION
"0"
"1"
"2"
"3"
"m"

LATCHING

P
STROBE SIGNAL
AUX. STROBE SIGNAL
MAIN STROBE SIGNAL

TOTAL AMOUNT OF ENERGY
0

METHOD OF AND SYSTEM FOR DRIVING THERMAL HEAD INCLUDING A PLURALITY OF HEATING ELEMENTS

The present invention relates to a method of driving a thermal head used in a tape printer or similar devices, where the head includes a plurality of heating elements which constitute a line of dots and are connected in parallel to a power source. Further, the present invention relates a system for driving such a thermal head.

BACKGROUND OF THE INVENTION

In a typical thermal head, a plurality of heating elements or heating resistors connected in parallel to a power source are disposed to form a line of dots on a substrate. The number of heating resistors corresponds to the number of dots included in one printing line. When a voltage is applied to one of the heating resistors, the heating resistor generates heat to destroy a thermosensitive layer of a printing tape so that a colored layer under the thermosensitive layer is exposed externally. Various characters (letters, symbols, etc.) can be printed on the printing tape by selectively applying a voltage to all or part of the heating resistors according to the dot pattern of the characters.

FIG. 5 shows an example of an electrical circuit for driving a thermal head. Symbols $R_1, R_2, R_3, \ldots, R_N$ denote heating resistors disposed in a line on a substrate (not shown). The number N is 96, for example, which means that a single printing line consists of 96 dots. Numeral 1 denotes a power source to which the heating resistors $R_1$–$R_N$ are connected in parallel. Numeral 2 denotes a controller constituted using a microcomputer or microcomputers, which controls every part of a printer. Besides, the controller 2 produces printing data, or dot pattern data, for printing characters, such as letters, symbols or graphics, inputted by a user through an input device (a keyboard, for example). The printing data is sent in serial to a head driver 3. The head driver 3 selectively applies voltages to all or part of the heating resistors $R_1$–$R_N$ based on the printing data.

Numeral 4 denotes a strobe signal generator, which is controlled by the controller 2 to generate a strobe signal of a preset pulse width in each printing cycle. Symbols $G_1, G_2, G_3, \ldots, G_N$ denote gates, each gate having two inputs. One of the two inputs receives the strobe signal from the strobe signal generator 4 and the other input receives the printing data from the controller 2. When the strobe signal and the printing data are sent to the gate $G_x$ ($1 \leqq x \leqq N$) at the same time, the output level of the gate $G_x$ turns from low to high, for example, and an electric current from the power source 1 is supplied to the corresponding heating resistor $R_x$.

As described above, the electric power is selectively supplied only to such heating resistors that correspond to the gates that receive the printing data from the controller 2 while the strobe signal is ON. FIG. 6 is a time chart showing an example of form of signals in a printing cycle T. Symbol W denotes the pulse width of the strobe signal St, and symbol Vd denotes the driving voltage of the power source 1. As shown in FIG. 6, the voltage Vd gradually drops while the strobe signal St is ON and the electric power is supplied to the heating resistors.

The magnitude of drop in the voltage Vd depends on the dot pattern. The reason is explained as follows, referring to FIG. 7. In FIG. 7, the image to be printed consists of a block letter "H" surrounded by a thin rectangular frame. Symbols La, Lb and Lc denote printing lines corresponding to different parts of the image. It is assumed here that the number of dots included in a printing line is 96. In printing the line La, electric power is supplied to all the heating resistors $R_1$–$R_N$ (N=96) corresponding to all dots. In printing the line Lb, electric power is supplied to the heating resistors that correspond to, for example, 2 dots in the upper side and 2 dots in the lower side of the frame. In printing the line Lc, electric power is supplied to the heating resistors that correspond to 2 dots in the upper side of the frame, 2 dots in the lower side of the frame and 56 dots, for example, constituting the left column of "H".

The pulse width W of the strobe signal St is fixed, as shown in FIG. 6. Under such a condition, the amount of electric power required for printing one line increases as the number of dots to be printed in the line increases, because the number of heating resistors to which electric power is supplied increases. As a result, the voltage drop of the power source 1 becomes larger. In printing the lines La, Lb and Lc, voltage drop becomes larger in the order of Lb<Lc<La.

In the line Lb, the print is hardly thin because the amount of energy consumed for printing is small and the voltage drop is adequately small. In the line La, by contrast, voltage drop is considerably large. The print in the line La, however, is hardly thin because of the following reason. Where dots to be printed constitute a continuous line as in the line La, the thermosensitive layer of the printing tape is adequately destroyed within the line because each part of the thermosensitive layer facing one heating resistor receives heat not only from said one heating resistor but also from the neighboring ones.

As for the line Lc, the print is hardly thin in the left column of "H" because the dots constitute a continuous line there. The dots in the upper and lower sides of the frame, by contrast, are isolated from the continuous line. Therefore, the heating resistors corresponding to the dots in the upper and lower sides of the frame cannot generate an adequate amount of heat because of the voltage drop. As a result, the print of the frame is thinner in the line Lc than in the other part.

In the above-described conventional method, the pulse width W of the strobe signal St is fixed, as described above. Even under this condition, however, thin print can be prevented by using a large capacity power source. In this case, however, overheating occurs in a line where only few dots are printed, as in the line Lb of FIG. 7, which causes blurring around the print. Further, a large capacity power source is expensive and inevitably increases the production cost of the printer.

When a small capacity power source is used, not only the cost is reduced but also blurring around the print due to overheating does not occur. There is a possibility, however, that the print becomes partly thin, as described above. Even when a small capacity power source is used, the thin print can be prevented by suppressing voltage drop by, for example, reducing the number of dots in a continuous line as in the line Lc. This method, however, requires a complicated process and it is practically impossible to completely eliminate the thin print.

Publication No. H2-196668 of the Japanese Unexamined Patent Application discloses a method of driving a thermal head. In the method, printing is suspended when the voltage becomes lower than a preset value during the printing, until the driving voltage of the power source is restored adequately. By this method, however, longer time is required for printing because the printing cycle becomes longer.

In view of the above-described problems, the present invention proposes a method of driving a thermal head of a printer wherein thin print due to voltage drop of a power source is prevented without reducing the number of dots or changing the printing cycle by an interruptive suspension.

SUMMARY OF THE INVENTION

Thus, the present invention proposes a method of driving a thermal head including a plurality of heating elements each corresponding to each of a plurality of dots constituting a line and connected in parallel to a power source, where printing is carried out by repeating a printing cycle, each printing cycle corresponding to one line and including steps of selecting a heating element or heating elements of the line according to printing data and supplying electric power to the heating element or heating elements selected, the method being characterized by that:

the plurality of heating elements are grouped into a plurality of blocks, and that each printing cycle includes steps of:

determining whether the number of all the heating elements selected in the line exceeds a preset number;

determining with respect to each block whether the ratio of the number of the heating element or heating elements selected to the number of heating elements included in the block is smaller than a preset value; and starting a power supply to the heating element or heating elements selected in a block or blocks in which the ratio is smaller than the preset value earlier than in the other blocks when the number of all the heating elements selected is larger than the preset number.

In the inventive method, the ratio of the number of heating elements selected to the number of heating elements included in a block, is calculated with respect to each of the blocks. The ratio is referred to as "duty ratio" hereinafter. Further, such a block where the duty ratio is smaller than the preset value, is referred to as "low-duty block" hereinafter.

While printing a line, when the number of all the heating elements selected in the line exceeds the preset number, the print is expected to be thin due to voltage drop in a low-duty block or low-duty blocks. Therefore, the power supply to the heating elements is started earlier in the low-duty block or low-duty blocks than in the other blocks. The degree of advancing the start of the power supply to the heating elements is predetermined so that proper amount of energy is supplied additionally to each of the heating elements to prevent the thin print.

By the above-described method, thin print is assuredly prevented without reducing the number of dots to be printed or changing the printing cycle by interruptive suspension. No complicated process is required to carry out the inventive method.

In a preferable mode of the method according to the present invention, the method further includes a step of determining whether the voltage of the power source is lower than a preset voltage at the start of each printing cycle, and the power supply to the heating elements selected is started earlier in the low-duty block or low-duty blocks than in the other blocks when the voltage is lower than the preset voltage.

By this method, thin print is assuredly prevented even when a small capacity power source is used. Using a small capacity power source is preferable in respect of reducing cost.

The present invention also proposes a system for driving a thermal head which performs printing by the above-described inventive method. That is, in a system for driving a thermal head including a plurality of heating elements each corresponding to each of a plurality of dots constituting a line and connected in parallel to a power source, where printing is carried out by repeating a printing cycle, each printing cycle corresponding to one line and including steps of selecting a heating element or heating elements of the line according to printing data and supplying electric power to the heating element or heating elements selected, the system according to the present invention is characterized by further including:

a grouping unit for grouping the plurality of heating elements into a plurality of blocks, a number-checking unit for determining whether a number of all the heating elements selected in the line exceeds a preset number;

a ratio-checking unit for determining with respect to each block whether a ratio of the number of the heating element or heating elements selected to a number of heating elements included in the block is smaller than a preset value; and a power supply controller for starting a power supply to the heating element or heating elements selected in a block or blocks in which the ratio is smaller than the preset value earlier than in other blocks when the number of all the heating elements selected is larger than the preset number.

DETAILED DESCRIPTION OF A PREFERRED EMBODIMENT

An embodiment of the present invention is described referring to FIGS. 1–5. In this embodiment, the method is applied to a tape printer having a thermal head and its driving circuit. The basic constitution of the thermal head and the circuit is the same as has been described referring to FIG. 5. Therefore, the following description is mainly focused on the features relating to the inventive method.

Characters (letters, symbols, figures, etc.) inputted through an input device (keyboard, mouse, etc.) are printed line by line in every printing cycle, each line consisting of 96 dots, for example. The controller 2 of the printer in FIG. 5 produces printing data for printing one line in each printing cycle. This printing data of a line is referred to as "main printing data" hereinafter.

Figure 5:
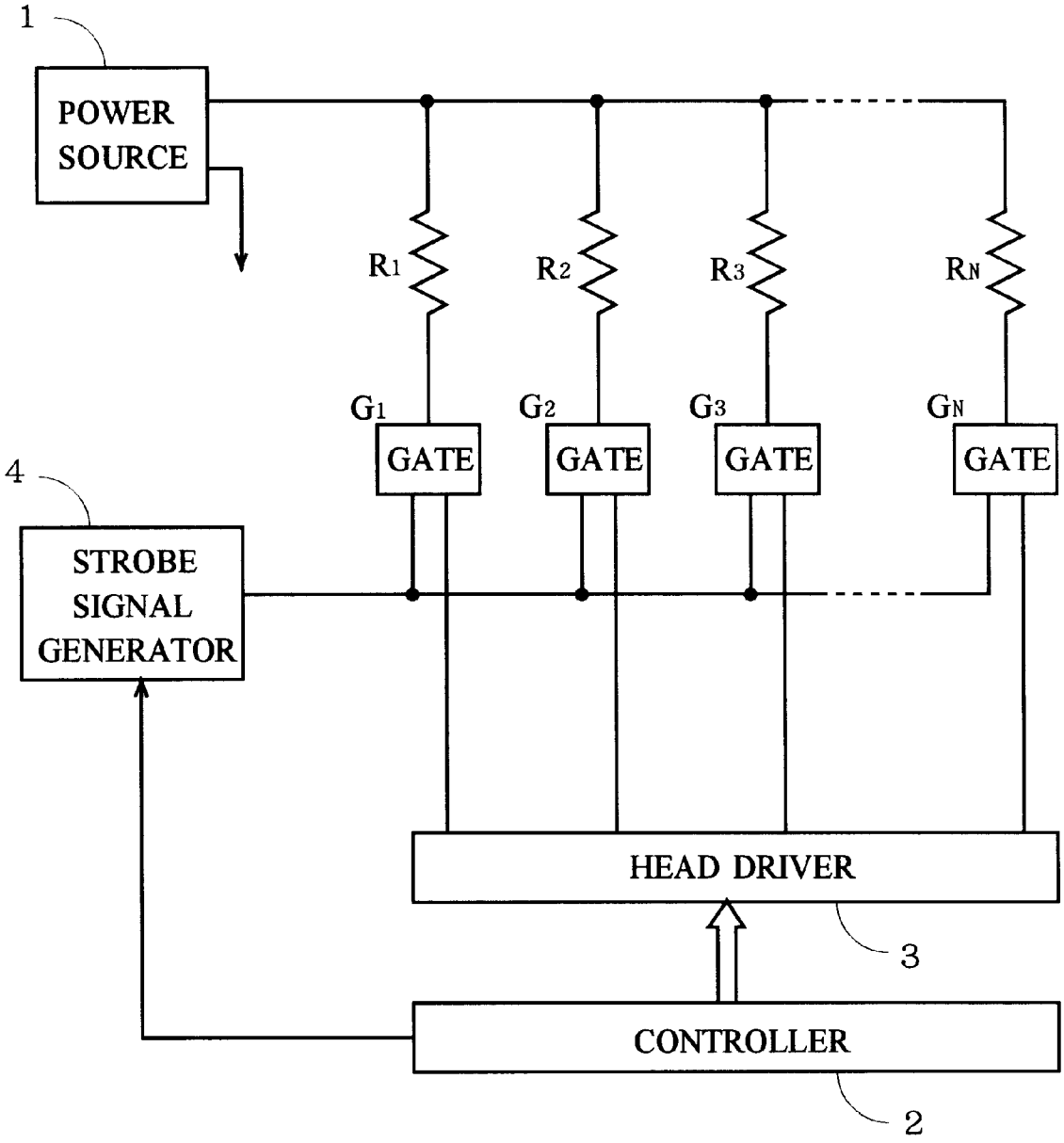
FIG. 5 is a diagram showing an electrical circuit for driving a thermal head.

The heating resistors $R_1$–$R_N$ in FIG. 5 are grouped into blocks including a preset number $N_1$ of heating resistors. The number $N_1$ is preset at 4, for example. Based on the main printing data, the controller 2 counts the number $N_2$ of heating resistors corresponding to dots to be printed in each block, and calculates the ratio of the number $N_2$ to the number $N_1$. Then, with respect to each block, the controller 2 determines whether the duty ratio of the block is equal to or smaller than a preset ratio, which is set at 2/4, for example, thus detecting a block or blocks where thin print is expected to occur. With respect to each low-duty block, the controller 2 produces auxiliary printing data for preheating the heating resistors in the low-duty block to which the main printing data is to be sent.

After that, the controller 2 determines whether the total number $N_3$ of all the heating resistors to which the main printing data is sent, is equal to or larger than a preset value of, for example, 60. When $N_3$ is found to be equal to or larger than the preset value, the controller 2 controls the strobe signal generator 4 to generate an auxiliary strobe signal, which is supplied to each of the gates $G_1$–$G_N$. Thus, the power supply to heating resistors to which the main printing data is to be sent, is started earlier in the low-duty blocks than in the other blocks. In the present embodiment, the auxiliary strobe signal is generated when the voltage of the power source 1 is lower than a preset voltage. This condition for generating the auxiliary strobe signal, however, is optional in the present invention.

When the auxiliary strobe signal is ON, electric power is supplied only through the gates that receive both the auxiliary printing data and the auxiliary strobe signal from the controller 2. That is, the electric power is supplied to preheat the heating resistors that correspond to dots at which the print is expected to be thin due to voltage drop of the power source 1. By this preheating, the energy shortage due to the voltage drop of the power source 1 will be compensated.

Figure 6:
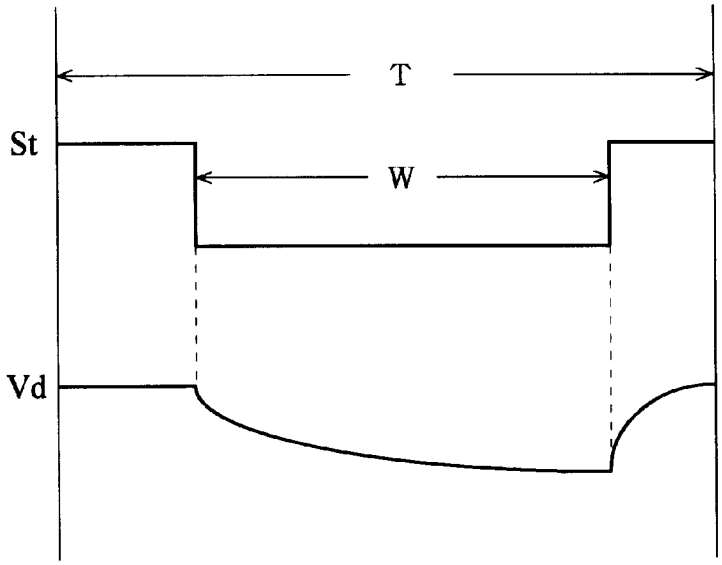
FIG. 6 is a time chart showing an example of form of signals according to a conventional method.

Subsequent to the auxiliary strobe signal, a main strobe signal is generated by the strobe signal generator 4, where the main strobe signal is equivalent to the conventional strobe signal described referring to FIG. 6. When the main strobe signal is supplied to each of the gates $G_1$–$G_N$, the main printing data is also supplied from the controller 2 to the gates $G_1$–$G_N$. Then, electric power is supplied to the heating resistors only through the gates that receive both the main strobe signal and the main-printing signal. Thus a printing cycle for one line is carried out. It should be understood that there is no actual difference between the auxiliary strobe signal and the main strobe signal. The two signals are only discriminated logically according to the control program.

Figure 1:
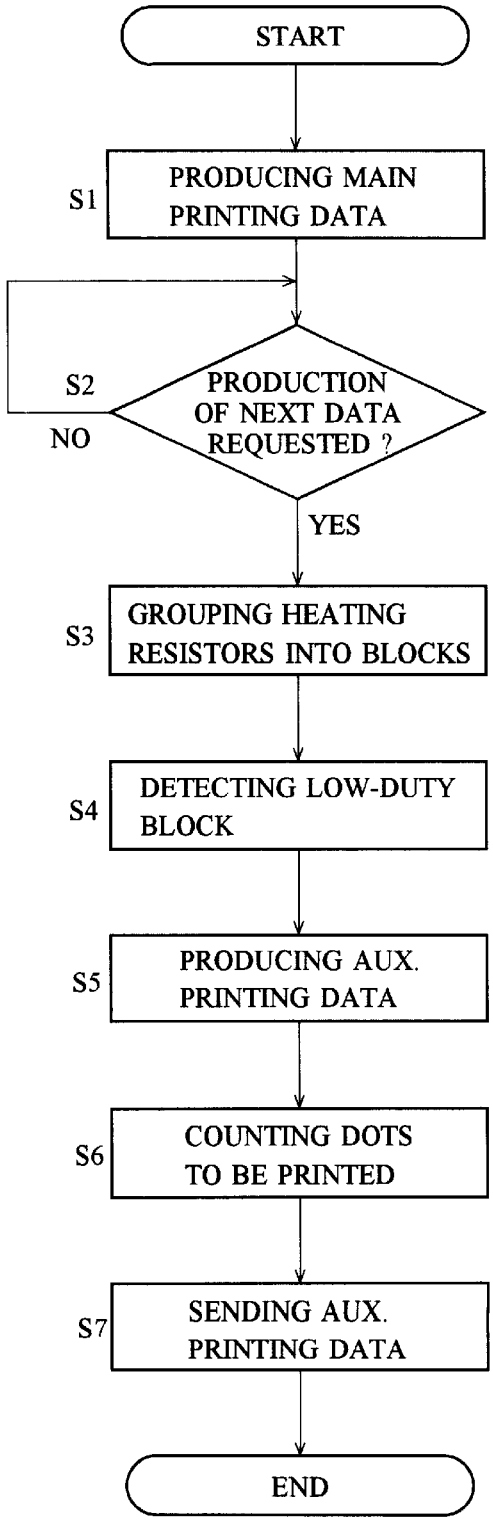
FIG. 1 is a first flow chart showing steps of the method in the embodiment.
Figure 2:
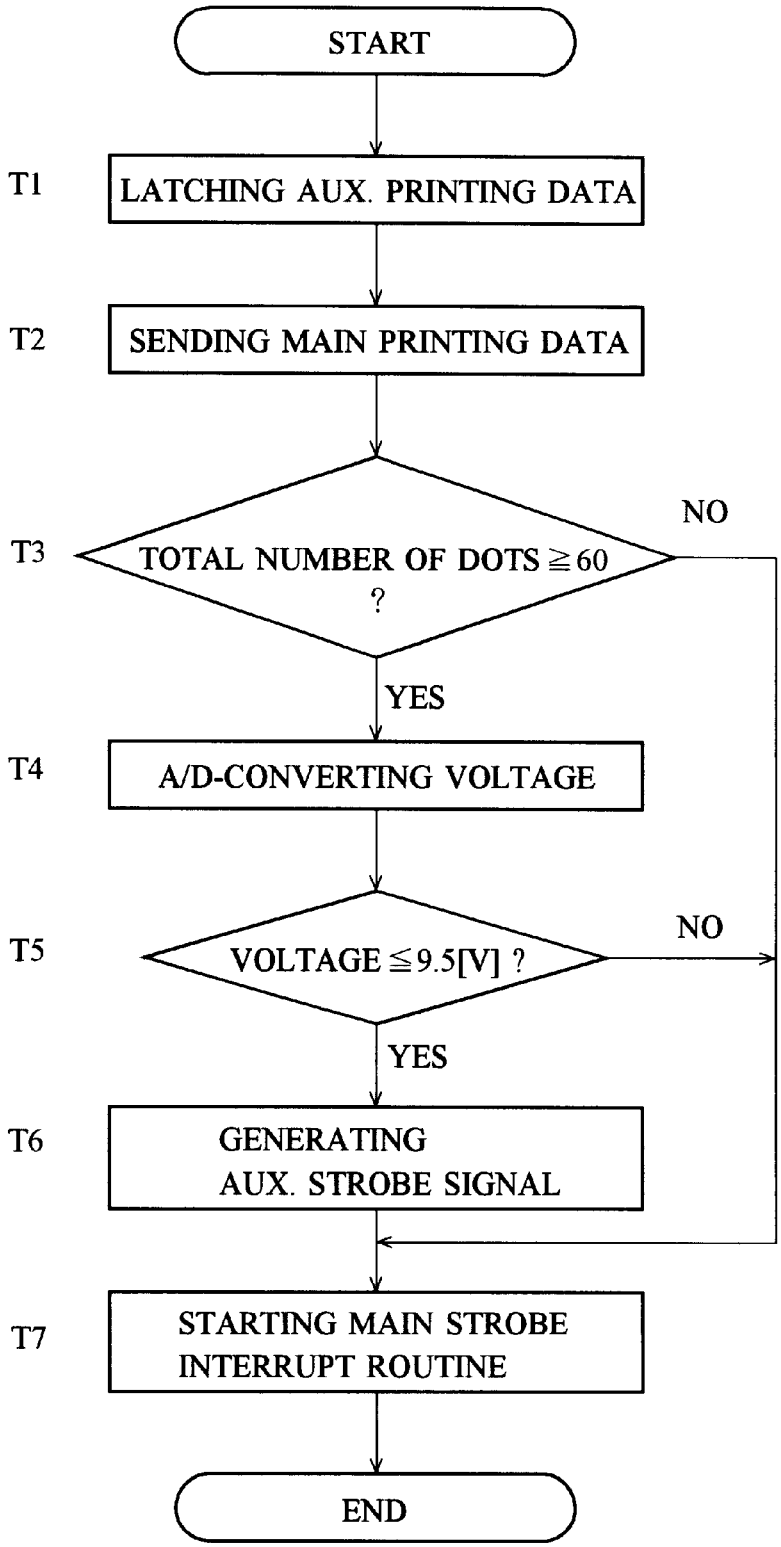
FIG. 2 is a second flow chart showing steps of the method in the embodiment.
Figure 3:
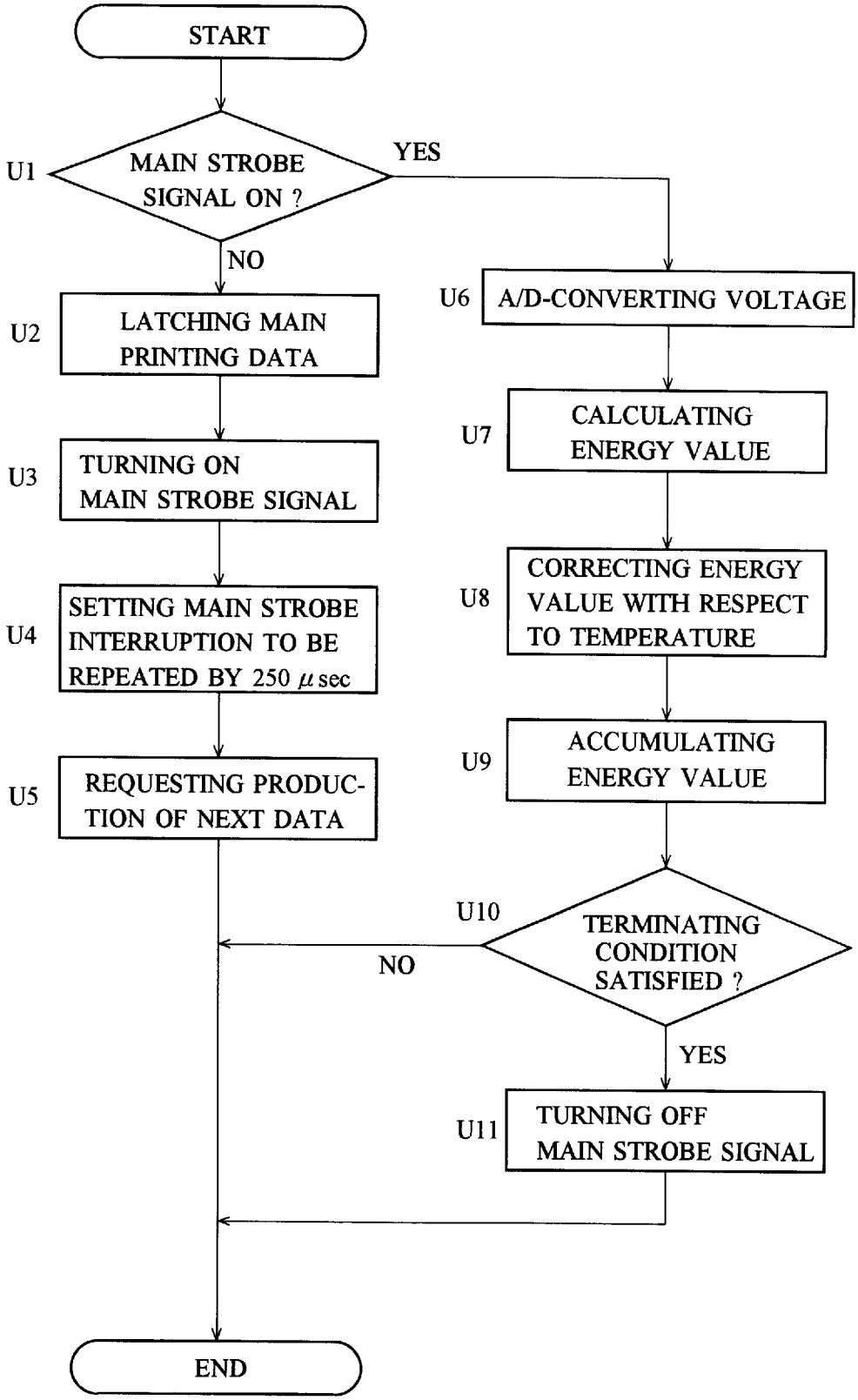
FIG. 3 is a third flow chart showing steps of the method in the embodiment.

The printing process in the present embodiment is detailed, referring to flow charts of FIGS. 1–3.

Referring to FIG. 1, first, the main printing data for printing one line (96 dots) of a character (letter, symbol, etc.) inputted through the input device is produced (Step S1). Next, it is checked whether production of main printing data for printing the next line is requested (Step S2). The check in Step S2 is repeated while the check result is "NO", i.e. until the production of the next main printing data is requested in Step U5, which is described later. When the check result is "YES" in Step S2, the operation proceeds to Step S3.

In Step S3, all the heating resistors $R_1$–$R_N$ shown in FIG. 5 are grouped into blocks including the same number $N_1$ of heating resistors ($N_1$=4, for example). Then, in Step S4, the detection of the low-duty block is carried out. That is, with respect to each block, it is determined whether the block is a low-duty block, based on whether the duty ratio of the block is equal to or smaller than the preset ratio of, for example, 2/4. After that, the auxiliary printing data is produced to preheat heating resistors in the low-duty block to which the main printing data produced in Step S1 is to be sent (Step S5). The auxiliary printing data is the same as the main printing data in the low-duty block.

After that, the total number $N_3$ of heating resistors to which the main printing data is sent is counted (Step S6), and the auxiliary printing data produced in Step S5 is sent in serial from the controller 2 to the head driver 3 (Step S7). Thus, the operation according to the flow chart of FIG. 1 is completed.

Synchronized with the start of a printing cycle, an interrupt routine as shown by the flow chart of FIG. 2 for generating the auxiliary strobe signal is started. In this routine, the auxiliary printing data produced in Step S5 of FIG. 1 is latched (Step T1), and the main printing data produced in Step S1 of FIG. 1 is sent in serial from the controller 2 to the head driver 3 (Step T2).

After that, it is checked whether the total number of all the dots to be printed, i.e. the number $N_3$ obtained in Step S6 of FIG. 1, is equal to or larger than a preset number of, for example, 60 (Step T3). When the check result is "YES", the voltage of the power source 1 is detected by a voltage detector (not shown) and is A/D-converted (Step T4).

In Step T5, it is checked whether the voltage value is smaller than a preset voltage of, for example, 9.5[V] (Step T5). When the check result is "YES", it is expected that the print will be partly thin due to voltage drop of the power source 1. Therefore, the strobe signal generator 4 generates an auxiliary strobe signal (Step T6). After that, Step T7 is carried out where an interrupt routine for generating a main strobe signal is started, and the auxiliary strobe interrupt routine ends completely. Step T7 is carried out also when the check result in Step T3 is "NO" or when the check result in Step T5 is "NO".

The main strobe interrupt routine is carried out according to the flow chart of FIG. 3. In this routine, it is checked first whether the main strobe signal is ON (Step U1). When the check result is "NO", it means that the auxiliary strobe signal and the auxiliary printing data are being supplied for preheating. In this case, the main printing data produced in Step T2 of FIG. 2 is latched (Step U2).

After that, the main strobe signal is turned ON (Step U3), and the main strobe interrupt routine is set to be repeated after a preset time period (Step U4). The time period is set at 250 [μsec], for example. The lapse of time period is checked by a not shown timer provided to the controller 2. After Step U4, the production of next main printing data is requested (Step U5), and the routine ends. The request in Step U5 triggers the procession of Step S2 to Step S3 in FIG. 1, as described before.

When the preset time period lapses, the main strobe routine starts again as set in Step U4. In the second and subsequent cycles of this routine, the check result in Step U1 is "YES" since the main strobe signal has already been ON. Thus, the operation proceeds to Step U6, where the voltage of the power source 1 detected by the voltage detector is A/D-converted. Based on the voltage value, the amount of energy supplied to the heating resistors is calculated (Step U7).

A conversion table for converting a voltage value of the power source 1 to an energy value is stored beforehand in a memory (not shown) provided in the controller 2. In Step U7, an energy value corresponding to the voltage value obtained in Step U6 is determined, using the conversion table.

The energy value determined in Step U7 is corrected with respect to the ambient temperature to obtain a correct energy value (Step U8). The energy value obtained through Steps U7 and U8 is accumulated every time the main strobe interrupt routine is carried out to obtain a total amount of energy supplied to the heating resistors (Step U9). After that, it is determined in Step U10 whether the condition for terminating the power supply is satisfied. The terminating condition is set as: whether the total amount of energy has reached a preset threshold, or whether the main strobe interrupt routine has been repeated by a preset number of cycles.

The threshold of the total amount of energy to determine whether to terminate the power supply is preset appropriately so that the thermosensitive layer of the printing tape is adequately destroyed by the heating resistors. Here, the threshold is set adequately low to prevent blurring around the print due to overheating. The number of cycles to terminate the power supply is determined regarding the repetition period (250 [μsec]) for the main strobe interrupt routine with respect to the printing cycle T. Specifically, the number of cycles is determined so that the main strobe signal is turned OFF before the end of the printing cycle T.

When the determination result in Step U10 is "NO", the routine once ends and the next cycle of the main strobe routine is carried out from Step U1 through Steps U6–U10. When, on the other hand, the determination result in Step U10 is "YES", the main strobe signal is turned OFF (Step U11), and the main strobe interrupt routine ends completely.

Figures 4A, 4B, 4C, 4D, 4E:
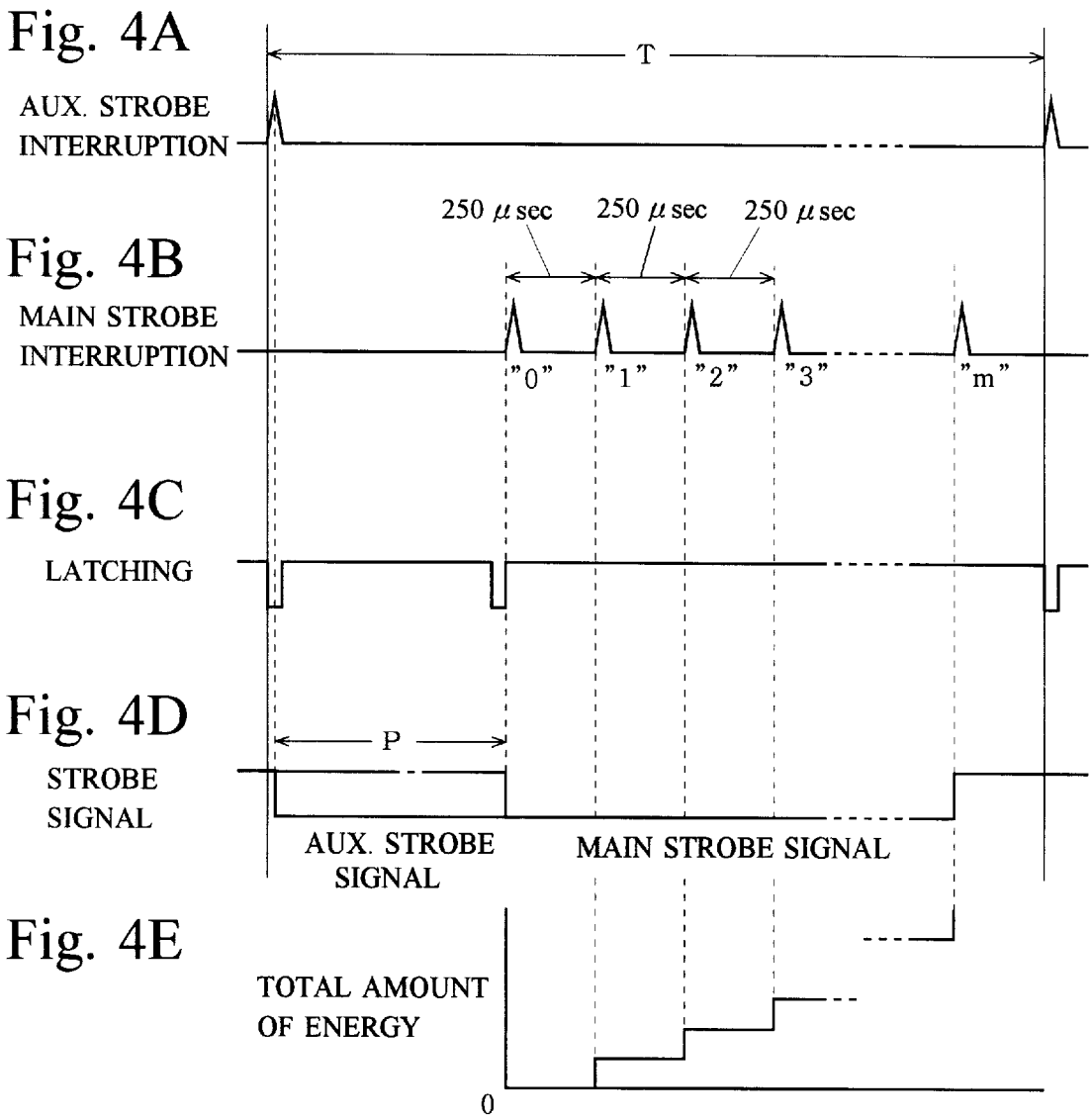
FIGS. 4A–4E are time charts showing status of signals in one printing cycle.

FIGS. 4A–4E are time charts showing the status of signals in one printing cycle T. At the beginning of the printing cycle T, the auxiliary strobe interrupt routine (see FIG. 2) is started, as shown in FIG. 4A. At the beginning of this routine, a latching signal for latching auxiliary printing signal in the auxiliary strobe interrupt routine (see Step T1 of FIG. 2) is generated at the timing as shown in FIG. 4C.

After that, the step of generating the auxiliary strobe signal is carried out in the auxiliary strobe interrupt routine (see Step T6 of FIG. 2), and the auxiliary strobe signal is sent to the gates $G_1$–$G_N$ for a time period of P from the strobe signal generator 4 as shown in FIG. 4D. Thus, electric power is supplied from the power source 1 to the heating resistors through the gates that receive the auxiliary printing data latched by the latching signal shown in FIG. 4C while the auxiliary strobe signal is ON, whereby the heating resistors in the low-duty blocks are preheated.

After that, the main strobe interrupt routine is set at the end of the auxiliary strobe interrupt routine (see Step T7 of FIG. 2). Thus, the first cycle of the main strobe interrupt routine (see FIG. 3) is started, as indicated by numeral "0" in FIG. 4B. At the beginning of this first cycle of the main strobe routine, a latching signal for latching the main printing data (see Step U2 of FIG. 3) is generated at the specific timing as shown in FIG. 4C.

After that, the step of generating a main strobe signal is carried out in the main strobe interrupt routine (see Step U3 of FIG. 3). The main strobe signal is sent from the strobe signal generator 4 to the gates $G_1$–$G_N$, as shown in FIG. 4D. Thus, electric power is supplied from the power source 1 to the heating resistors through the gates that receive the main printing data latched by the latching signal shown in FIG. 4C while the main strobe signal is ON, whereby the printing is started.

The cycle time for repeating the main strobe interrupt routine is set at 250 [μsec] in Step U4 of FIG. 3, as described above. Therefore, the first cycle of the main strobe interrupt routine is ended when 250 [μsec] has elapsed from the start of the cycle. Subsequent to that, the next cycle of the main strobe interrupt routine is started as indicated by the numeral "1" in FIG. 4B. In the second and subsequent cycles, the energy value is accumulated in Step U9 of FIG. 3 to obtain the total amount of energy supplied to the heating resistors. The total amount of energy increases at every cycle, as shown in FIG. 4E. The total amount of energy and the number of cycles repeated are checked in Step U10 of FIG. 3 to determine whether the terminating condition is satisfied.

When the terminating condition is not satisfied, the main strobe interrupt routine is repeated for the third and subsequent cycles by the repetition period of 250 [μsec], as indicated by the numerals "2", "3", . . . , "m" in FIG. 4B. When the terminating condition is satisfied, the main strobe signal is turned OFF as shown in FIG. 4D, and the main strobe interrupt routine ends completely. Thus, the printing of one line is completed.

Figure 7:
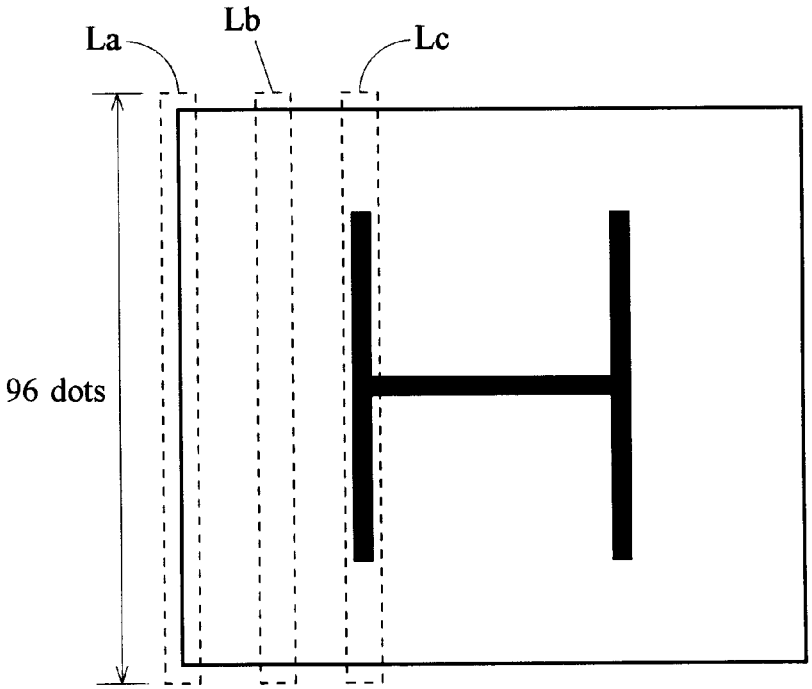
FIG. 7 is an example of a print image.

By the above-described method, for example, while printing the line Lc of FIG. 7, the heating resistors corresponding to the dots of the upper and lower sides of the frame are preheated by the auxiliary strobe signal and the auxiliary printing data. Thus the energy shortage due to voltage drop of the power source 1 is compensated and thin print is prevented at those dots.

While printing the line La of FIG. 7, there is no block where the duty ratio is equal to or smaller than the preset ratio of 2/4. Therefore, no auxiliary printing data is produced in Step S5 of FIG. 1 and, accordingly, no auxiliary strobe signal is generated (see the chain line of FIG. 4D). Also, while printing the line Lb of FIG. 7, no auxiliary strobe signal is generated because the determination result in Step T3 of FIG. 2 is "NO".

Thus, by the method of the above-described embodiment, any part of the print image is assuredly prevented from being thin due to voltage drop of the power source 1, without reducing the number of dots to be printed or changing the printing cycle. No complicated process is required to carry out the method. Further, there is no probability of causing the total printing time to be longer.

Further, in the above-described embodiment, the auxiliary strobe signal is generated when the voltage of the power source 1 is lower than a preset voltage of 9.5[V] (see Step T5 of FIG. 2). By such a method, thin print due to voltage drop is prevented even when the capacity of the power source 1 is small. Thus, the inventive method can be carried out with low cost by using a small capacity power source.

In addition, it should be noted that the preset values relevant to the control process of the invention may be different from the values referred to in the embodiment. That is, the preset number $N_1$ of 4 used in Step S3 of FIG. 1, the preset duty-ratio of 2/4 used in Step S4 of FIG. 1, the preset number of 60 used in Step T3 of FIG. 2, and the preset voltage value of 9.5[V] used in Step T5 of FIG. 2, may be preset at different values, taking account of the property of the thermal head, the number of dots constituting the head, the thermal property of the printing tape, etc.

Also, it should be appreciated that the present invention is applicable not only to tape printers but also to other devices using thermal head technology, where the same effects as described in the embodiment are also obtained.

What is claimed is:

1. A method of driving a thermal head including a plurality of heating elements each corresponding to each of a plurality of dots constituting a line and connected in parallel to a power source, where printing is carried out by repeating a printing cycle, each printing cycle corresponding to one line and including steps of selecting a heating element or heating elements of the line according to printing data and supplying electric power to the heating element or heating elements selected, the method being characterized by that:

the plurality of heating elements are grouped into a plurality of blocks, and that each printing cycle includes steps of:

determining whether a number of all the heating elements selected in the line exceeds a preset number;

determining with respect to each block whether a ratio of the number of the heating element or heating elements selected to a number of heating elements included in the block is smaller than a preset value; and starting a power supply to the heating element or heating elements selected in a block or blocks in which the ratio is smaller than the preset value earlier than in other blocks when the number of all the heating elements selected is larger than the preset number.

2. The method according to claim 1, wherein the printing data includes main printing data and auxiliary printing data, and the auxiliary printing data is sent to the heating element or heating elements selected in the block or blocks in which the ratio is smaller than the preset value before the main printing data is sent to the heating element or heating elements selected.

3. The method according to claim 1, further comprising a step of determining whether a voltage of the power source is lower than a preset voltage at a beginning of each printing cycle, and the power supply to the heating element or heating elements selected is started earlier in the block or blocks in which the ratio is smaller than the preset value than in the other blocks when the voltage is lower than the preset voltage.

4. The method according to claim 2, further comprising a step of determining whether a voltage of the power source is lower than a preset voltage at a beginning of each printing cycle, and the power supply to the heating element or heating elements selected is started earlier in the block or blocks in which the ratio is smaller than the preset value than in the other blocks when the voltage is lower than the preset voltage.

5. The method according to claim 1, wherein an amount of electric energy supplied from the power source to the heating element or heating elements selected is monitored, and the power supply is terminated when the amount of energy reaches a preset threshold.

6. The method according to claim 2, wherein an amount of electric energy supplied from the power source to the heating element or heating elements selected is monitored, and the power supply is terminated when the amount of energy reaches a preset threshold.

7. The method according to claim 5, wherein the amount of electric energy is corrected with respect to an ambient temperature.

8. The method according to claim 6, wherein the amount of electric energy is corrected with respect to an ambient temperature.

9. A system for driving a thermal head comprising a plurality of heating elements each corresponding to each of a plurality of dots constituting a line and connected in parallel to a power source, where printing is carried out by repeating a printing cycle, each printing cycle corresponding to one line and including steps of selecting a heating element or heating elements of the line according to printing data and supplying electric power to the heating element or heating elements selected, the system being characterized by further comprising:

a grouping unit for grouping the plurality of heating elements into a plurality of blocks, a number-checking unit for determining whether a number of all the heating elements selected in the line exceeds a preset number;

a ratio-checking unit for determining with respect to each block whether a ratio of the number of the heating element or heating elements selected to a number of heating elements included in the block is smaller than a preset value; and a power supply controller for starting a power supply to the heating element or heating elements selected in a block or blocks in which the ratio is smaller than the preset value earlier than in other blocks when the number of all the heating elements selected is larger than the preset number.

10. The system according to claim 1, wherein the printing data includes main printing data and auxiliary printing data, and the auxiliary printing data is sent to the heating element or heating elements selected in the block or blocks in which the ratio is smaller than the preset value before the main printing data is sent to the heating element or heating elements selected.

11. The system according to claim 9, further comprising a voltage-checking unit for determining whether a voltage of the power source is lower than a preset voltage at a beginning of each printing cycle, and the power supply to the heating element or heating elements selected is started earlier in the block or blocks in which the ratio is smaller than the preset value than in the other blocks when the voltage is lower than the preset voltage.

12. The system according to claim 10, further comprising a voltage-checking unit for determining whether a voltage of the power source is lower than a preset voltage at a beginning of each printing cycle, and the power supply to the heating element or heating elements selected is started earlier in the block or blocks in which the ratio is smaller than the preset value than in the other blocks when the voltage is lower than the preset voltage.

13. The system according to claim 9, further comprising an energy monitor for monitoring an amount of electric energy supplied from the power source to the heating element or heating elements selected, wherein the power supply is terminated when the amount of energy monitored thereby reaches a preset threshold.

14. The system according to claim 10, further comprising an energy monitor for monitoring an amount of electric energy supplied from the power source to the heating element or heating elements selected, wherein the power supply is terminated when the amount of energy monitored thereby reaches a preset threshold.

15. The system according to claim 13, wherein the amount of electric energy is corrected with respect to an ambient temperature.

16. The system according to claim 14, wherein the amount of electric energy is corrected with respect to an ambient temperature.

* * * * *